US006885350B2

(12) United States Patent
Godard et al.

(10) Patent No.: US 6,885,350 B2
(45) Date of Patent: Apr. 26, 2005

(54) MICROSTRIP FED LOG PERIODIC ANTENNA

(75) Inventors: Jeffrey A. Godard, Littleton, CO (US); Steven C. Olson, Broomfield, CO (US)

(73) Assignee: ARC Wireless Solutions, Inc., Wheat Ridge, CO (US)

( * ) Notice: Subject to any disclaimer, the term of this patent is extended or adjusted under 35 U.S.C. 154(b) by 595 days.

(21) Appl. No.: 10/108,931

(22) Filed: Mar. 29, 2002

(65) Prior Publication Data

US 2004/0145531 A1 Jul. 29, 2004

(51) Int. Cl.[7] ..... H01Q 11/10; H01Q 21/00

(52) U.S. Cl. ..... 343/792.5; 343/793; 343/795; 343/810

(58) Field of Search ..... 343/792.5, 793, 343/794, 795, 797, 803, 810, 812, 815, 700 MS, 818–819; H01Q 11/10, 21/00

(56) References Cited

U.S. PATENT DOCUMENTS

| | | | | |
|---|---|---|---|---|
| 2,860,339 A | | 11/1958 | Kandoian | 343/795 |
| 2,978,703 A | | 4/1961 | Kuecken | 343/803 |
| 3,286,268 A | * | 11/1966 | Barbano | 343/792.5 |
| 3,984,841 A | | 10/1976 | Mikulich, Jr. et al. | 343/792.5 |
| 4,825,220 A | | 4/1989 | Edwards et al. | 343/795 |
| 5,093,670 A | | 3/1992 | Braathen | 343/792.5 |
| 5,532,707 A | | 7/1996 | Klinger | 343/793 |
| 5,572,222 A | | 11/1996 | Mailandt et al. | 343/700 MS |
| 5,724,051 A | | 3/1998 | Mailandt | 343/795 |
| 5,917,455 A | | 6/1999 | Huynh et al. | 343/792.5 |
| 5,936,590 A | | 8/1999 | Funder | 343/795 |
| 6,121,937 A | | 9/2000 | Podger | 343/792.5 |
| 6,133,889 A | | 10/2000 | Yarsunas et al. | 343/792.5 |
| 6,243,050 B1 | | 6/2001 | Powell | 343/792.5 |
| 6,285,336 B1 | | 9/2001 | Zimmerman | 343/803 |
| 6,317,099 B1 | | 11/2001 | Zimmerman | 343/803 |
| 6,650,301 B1 | | 11/2003 | Zimmerman | 343/803 |
| 6,697,029 B2 | | 2/2004 | Teillet | 343/797 |
| 6,717,555 B2 | | 4/2004 | Teillet | 343/797 |

* cited by examiner

*Primary Examiner*—Trinh Vo Dinh
(74) *Attorney, Agent, or Firm*—Ancel W. Lewis, Jr.

(57) ABSTRACT

A microstrip fed log periodic antenna has two spaced dipole strips mounted on a ground plane. Each dipole strip has a trunk with a base, tip and alternating arms extending perpendicular to the trunk. One dipole strip includes an integral transmission feed line that extends from the tip, along the trunk of the other dipole strip at constant distance and along the ground plane at a constant distance. The one piece dipole strip with the integral transmission feed line reduces passive intermodulation and simplifies manufacture.

7 Claims, 2 Drawing Sheets

MICROSTRIP FED LOG PERIODIC ANTENNA

TECHNICAL FIELD

The present invention relates to antennas and more particularly to a microstrip fed log periodic antenna with a one piece transmission feed line and radiating element.

BACKGROUND ART

Log periodic antennas operate over a broad frequency range. Generally log periodic antennas have a plurality of dipole elements in a planar spaced array. The length of the elements and the spacing between the elements are selected in accordance with a mathematical formula, with the shortest elements being near the top of the antenna. Feed conductors generally connect at the tip of the antenna. Electrical connections from feed conductors to opposed elements are alternated to provide a 180 degree phase shift between successive elements.

U.S. Pat. No. 5,093,670 to Braathen discloses a log periodic antenna formed by printed circuit board manufacturing methods onto an insulative substrate. The dipole elements and one feed conductor are formed on one side of the substrate and a second feed conductor is formed on the opposite side of the substrate. Vias though the substrate connect the second feed conductor to alternating opposed dipole elements.

U.S. Pat. No. 5,917,455 to Huynh et al. discloses an array of log periodic antennas mounted on a backplane. Each antenna includes two flat dipole strips of conductive material with bases of the dipole strips mounted to the backplane in a spaced configuration. Each antenna is fed by a coaxial feed line with the center conductor being connected to one dipole strip and the jacket conductor being connected to the other dipole strip.

U.S. Pat. No. 6,133,889 to Yarsunas et al. and U.S. Pat. No. 6,243,050 to Powell disclose antennas with log periodic dipole assemblies fed by a microstrip feed line. Each dipole assembly has two flat dipole strips of conductive material with the bases of the dipole strips being mounted to a backplane in a spaced configuration. The feed line extends between the dipole strips of a dipole assembly and is connected to one dipole strip of the dipole assembly with a connector either at the top of the dipole strip or intermediate the top and the base of the dipole strip. The other dipole strip of the dipole assembly is not connected to the feed line.

The "diode junction effect" can be caused by metal to metal junctions, such as welded, soldered, riveted or bolted junctions, in electronic circuitry. This "diode junction effect" creates a non-linear voltage-current characteristic that, in radio frequency (RF) signals, can create intermodulation products that are different than the original frequencies. Passive intermodulation (PIM) may manifest as relatively strong interference signals. It is therefore desirable to avoid metal to metal junctions between the feed line and the tip of a log periodic dipole antenna, and in the feed line to the antenna.

DISCLOSURE OF THE INVENTION

A microstrip fed log periodic antenna includes a first and second dipole strips and a ground plane. The first and second dipole strips each include a trunk with a base and a tip opposite the base, and spaced dipole arms extending from each trunk. The bases of the first and second dipole strips mount to the ground plane in a spaced relationship. The first dipole strip includes a transmission feed line that is integral and one piece with the first dipole strip. The transmission feed line extends from the tip of the trunk of the first dipole strip, bends over and extends in a spaced relationship along the trunk of the second dipole strip to near the ground plane. The transmission feed line may further extend in a spaced relationship to the ground plane.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
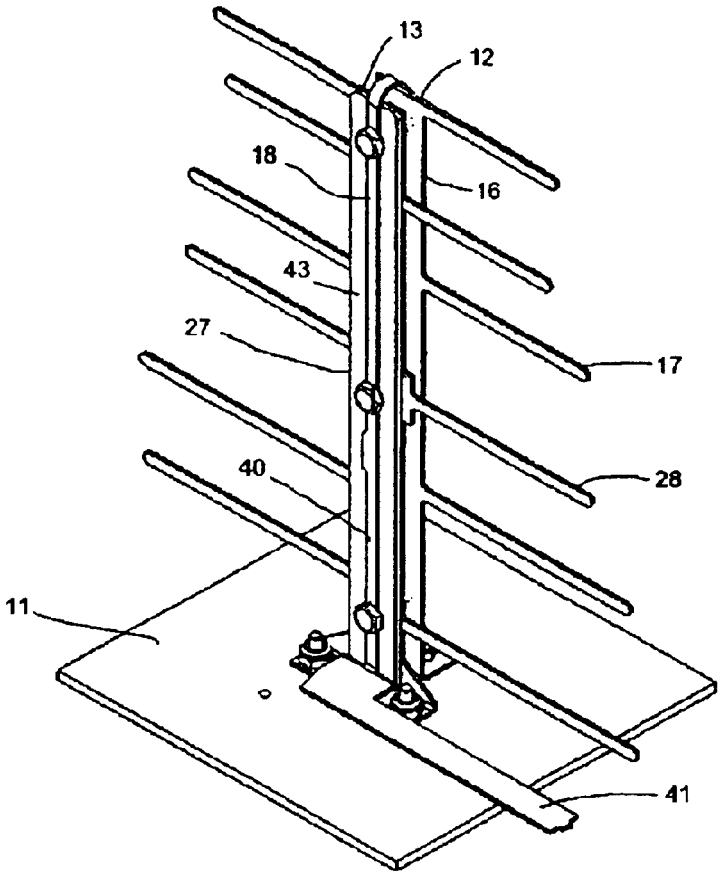
FIG. 1 is a perspective view of an antenna embodying features of the present invention.
Figure 2:
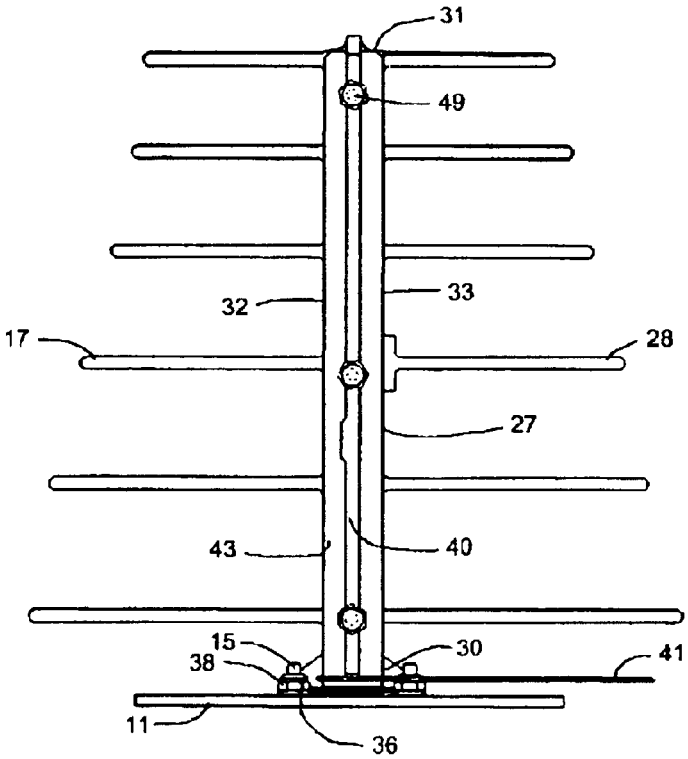
FIG. 2 is a front elevation view of the antenna of FIG. 1.
Figure 3:
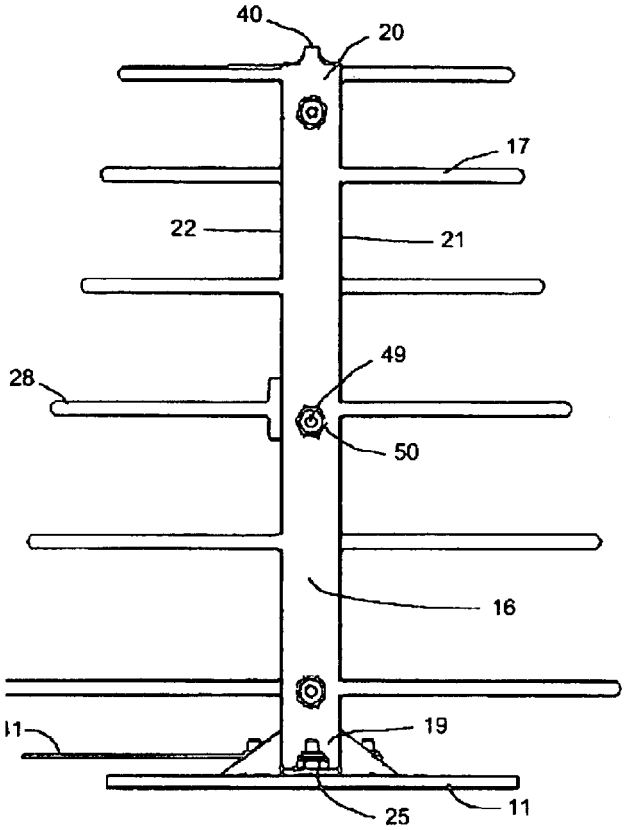
FIG. 3 is a rear elevation view of the antenna of FIG. 1.
Figure 4:
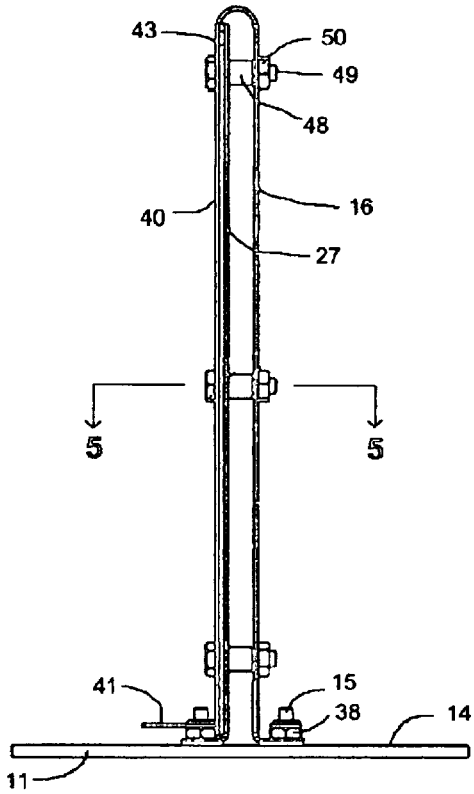
FIG. 4 is a side elevation view of the antenna of FIG. 1.
Figure 5:
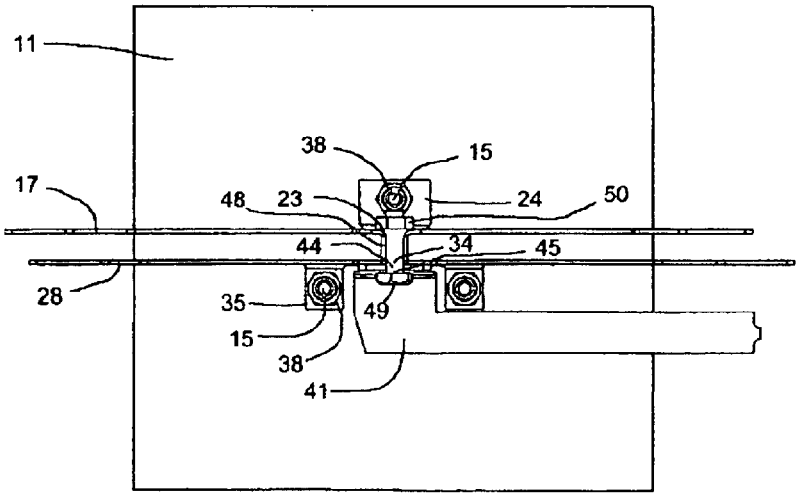
FIG. 5 is a sectional view along line 5—5 of FIG. 4.

Referring now to FIGS. 1 to 4, a log periodic antenna embodying features of the present invention includes a ground plane 11, a first dipole strip 12 and a second dipole strip 13. The ground plane 11 is a planar rectangular conductive plate with a flat surface 14 and a plurality of threaded studs 15 extending transverse to the flat surface 14. In the preferred embodiment, the ground plane 11 is made from aluminum, but other conductive materials such as copper or brass can be used.

The first dipole strip 12 is formed in one piece from a conductive material with good bending characteristics. In the preferred embodiment, the first dipole strip 12 is made from aluminum, but other materials such as copper, brass or a flexible printed circuit material can be used. The first dipole strip has a first trunk 16 with a plurality of spaced first dipole arms 17 and a transmission feed line shown as microstrip feed line 18. The first trunk 16 has a flat rectangular shape with a base 19, a tip 20 opposite the base 19, and spaced first and second side edges 21 and 22 extending from the base 19 to the tip 20. The first dipole arms 16 have a flat, generally rectangular shape and extend transversely from the first and second side edges 21 and 22 in a spaced alternating order. The first trunk 16 includes first trunk apertures 23 spaced between the base 19 and the tip 20, intermediate the first and second side edges 21 and 22. A flat base first tab 24 extends transversely from base 19 and includes first base apertures 25 extending through the base first tab 24.

In the preferred embodiment, the second dipole strip 13 is made from aluminum, but other materials such as copper, brass or a flexible printed circuit material can be used. The second dipole strip has a second trunk 27 with a plurality of spaced second dipole arms 28. The second trunk 27 has a flat rectangular shape with a base 30, a tip 31 opposite the base 30, and spaced first and second side edges 32 and 33 extending from the base 30 to the tip 31. The second dipole arms 28 have a flat, generally rectangular shape and extend transversely from the first and second side edges 32 and 33 in a spaced alternating order. The second trunk 27 includes second trunk apertures 34 spaced between the base 30 and the tip 31, intermediate the first and second side edges 32 and 33. Flat base second tabs 35 extend transversely from base 30 and each include a second base aperture 36 extending through the base second tab 35.

The first and second dipole strips 12 and 13 mount to the ground plane 11 in spaced, parallel configuration with the first trunk apertures 23 and the second trunk apertures 34 in alignment and with the first dipole arms 17 of the first dipole strip 12 and the second dipole arms 28 of the second dipole strip 13 extending oppositely. The first and second dipole strips 12 and 13 are mounted with the studs 15 through the first and second base apertures 25 and 36 of the first and second base tabs 24 and 35, and with threaded first nuts 38 threaded onto studs 15 over the first and second apertures 25 and 36. Other fasteners or other systems of mounting and electrically connecting the first and second dipole strips 12 and 13 to the ground plane 11 may be used such as welding, swaging, riveting, soldering, or capacitive coupling.

The microstrip feed line 18 has a first feed line section shown as first microstrip section 40 and a second feed line section shown as second microstrip section 41. The first microstrip section 40 has a thin rectangular shape and extends from the tip 20, intermediate the first and second side edges 21 and 22, of the first trunk 16. The first microstrip section 40 bends about 180° and extends at a uniform distance along the second trunk 27 from the tip 31 to near the base 30 of second trunk 27. The second microstrip section 41 has a flat L shape and extends from the first microstrip section 40, at a uniform distance from the ground plane 11, transversely away from the trunk 27 of the second dipole strip 13, turns 90°, and extends sideways.

A dielectric spacer 43 having a rectangular shape and a uniform thickness is located between the second trunk 27 and the first microstrip section 40 to maintain the uniform distance between the second trunk 27 and the first microstrip section 40. The dielectric spacer 43 includes spacer apertures 44 that align with the second trunk apertures 34. The first microstrip section 40 includes microstrip apertures 45 that align with the spacer aperture 44. Hollow, cylindrical, nonconductive trunk spacers 48 are located between first trunk 16 and second trunk 27 in alignment with first and second trunk apertures 23 and 34. Nonconductive threaded bolts 49 extend through first trunk apertures 23, through trunk spacers 48, through second trunk apertures 34, through spacer apertures 44 and through microstrip apertures 45. Nonconductive threaded second nuts 50 thread onto bolts 49 to secure the first trunk 16, the second trunk 27 and the first microstrip section 40 at the selected distances. Other fastening systems such as nonconductive rivets or grommets may be used instead of bolts 49 and second nuts 50. Non-conductive clips may also be used which may reduce or eliminate the need for the first trunk apertures 23, the second trunk apertures 34, and the microstrip apertures 45, for trunk spacers 48 and dielectric spacer 43.

Although, in the preferred embodiment the first and second trunks 16 and 27 have a rectangular shape and are spaced in a uniform, parallel fashion to excite the gap between the first and second trunks 16 and 27 in parallel plate mode, other configurations may be used. By way of example, and not as a limitation, the first and second trunks 16 and 27 can taper inwardly toward tips 20 and 31, with the spacing between the first and second trunks 16 and 27 decreasing from bases 19 and 30 to tips 20 and 31.

The second trunk 27 is the transmission line ground for the first microstrip section 40 and ground plane 11 is the transmission line ground for the second microstrip section 41. Although the first microstrip section 40 has a generally rectangular shape and uniformly spaced from the second trunk 27, other configurations that provide the desired impedance at the tip 20 of the first trunk 16 are suitable. The shape of the second microstrip section 41, and the spacing between the second microstrip section 41 and the ground plane 11 can vary. In an array of log periodic antennas, the second microstrip section 41 can be common to all of the antennas and can be shaped with transformers and tapers to regulate the power and phase to each antenna. In such an array, with the second microstrip section 41 common to all of the antennas, a single metal to metal junction may be required between the array and an external transmission line, and passive intermodulation may be significantly reduced relative to prior known antennas.

The log periodic antenna of the present invention connects to the transmission feed line in the form of first microstrip section 40 without any metal to metal junctions at the tip of the antenna or along first or second trunks 16 and 27. Transmission line types other than microstrip may be used, with the transmission feed line being integral and one piece with the first dipole strip. By way of example, and not as a limitation, second trunk 27 combined with a spaced second ground with the first feed line section therebetween would form a stripline.

Since the first microstrip section 40 connects to tip 20 of the first trunk 16 without any metal to metal junctions, the antenna of the present invention has significantly reduced passive intermodulation relative to prior known log periodic antennas. The microstrip feed line 18 does not require welding, soldering, riveting or bolting to connect to the tip of the antenna, thereby reducing the manufacturing cost of the antenna of the present invention.

Although the present invention has been described with a certain degree of particularity, it is understood that the present disclosure has been made by way of example and that changes in details of structure may be made without departing from the spirit thereof.

What is claimed is:

1. A log periodic antenna comprising:

a ground plane, a one piece first dipole strip having a first trunk with a base, a tip and a plurality of spaced dipole arms extending transverse said first trunk between said base and said tip, said base being mounted on said ground plane, said first dipole strip including an integral transmission feed line that has a first feed line section that extends from said tip of said first trunk, and a second dipole strip having a second trunk with a base, a tip and a plurality of spaced dipole arms extending transverse said second trunk between said base and said tip, said base of said second trunk being mounted on said ground plane and spaced from said first trunk, with said first feed line section bending over and extending, at a selected distance, along said second trunk to near said ground plane, whereby metal to metal junctions between said first trunk and said transmission feed line are eliminated, and passive intermodulation is reduced.

2. The antenna as set forth in claim 1 wherein said transmission feed line is a microstrip feed line.

3. The antenna as set forth in claim 1 wherein:

said ground plane includes a plurality of threaded studs and threaded first nuts, said base of said first trunk includes a base first tab with first base apertures therethrough, said base of said second trunk includes base second tabs each with a second base aperture therethrough, with said first and second trunks being mounted on and electrically connected to said ground plane with said studs through said first and second base apertures and with a said first nut threaded onto each said stud.

4. The antenna as set forth in claim 1 wherein said transmission feed line includes a second feed line section that extends transversely from said first feed line section in a spaced relationship with said ground plane.

5. The antenna as set forth in claim 1 including a dielectric spacer located between said second trunk and said first feed line section.

6. The antenna as set forth in claim 5 including:

a plurality of first trunk apertures through said first trunk, a plurality of second trunk apertures through said second trunk, aligned with said first trunk apertures, a plurality of spacer apertures through said dielectric spacer, aligned with said second trunk apertures, a plurality of microstrip apertures through said first microstrip section, aligned with said spacer apertures, a plurality of nonconductive, hollow cylindrical spacers aligned between said first and second trunk apertures, a plurality of threaded nonconductive bolts with each said bolt extending through a said first trunk aperture, a said cylindrical spacer, a said second trunk aperture, a said spacer aperture and a said microstrip aperture, and a threaded nonconductive second nut threaded onto each said bolt.

7. A log periodic antenna comprising:

a ground plane with a plurality of threaded studs and threaded first nuts, a one piece first dipole strip having a first trunk with a base, a tip and a plurality of spaced dipole arms extending transverse said first trunk between said base and said tip, said base having a base first tab with first base apertures therethrough, said base being mounted on said ground plane with said studs extending through said first base apertures and a said first nut threaded onto each said stud, said first dipole strip including an integral microstrip feed line that has a first microstrip section and a second microstrip section with said first microstrip section extending from said tip of said first trunk, a second dipole strip having a second trunk with a base, a tip and a plurality of spaced dipole arms extending transverse said second trunk between said base and said top, said base having base tabs each with a second base aperture therethrough, said base being mounted on said ground plane, and spaced from said first trunk, with said studs extending through said second base apertures and a said first nut threaded onto each said stud, and a dielectric spacer, said first microstrip section bending over and extending, at a selected distance, along said second trunk to near said ground plane, said dielectric spacer being located between said second trunk and said first microstrip section, with said second microstrip section extending transversely from said first microstrip section in a spaced relationship with said ground plane, whereby metal to metal junctions between said first trunk and said microstrip feed line are eliminated, and passive intermodulation is reduced.

* * * * *